United States Patent [19]

Worner

[11] Patent Number: 4,906,290

[45] Date of Patent: Mar. 6, 1990

[54] MICROWAVE IRRADIATION OF COMPOSITES

[75] Inventor: Howard K. Worner, Wollongong, Australia

[73] Assignee: Wollongong Uniadvice Limited, New South Wales, Australia

[21] Appl. No.: 186,299

[22] Filed: Apr. 26, 1988

[30] Foreign Application Priority Data

Apr. 28, 1987 [AU] Australia ..... PI1623

[51] Int. Cl.[4] ..... C22B 4/00

[52] U.S. Cl. ..... 75/10.13; 75/10.1; 75/10.46; 75/10.62; 75/10.67; 75/89; 204/157.43

[58] Field of Search ..... 204/157.43; 75/10.46, 75/10.62, 10.1, 10.13, 10.67, 89

[56] References Cited

U.S. PATENT DOCUMENTS

| | | | |
|---|---|---|---|
| 1,582,157 | 4/1923 | Beckman | 75/10.46 |
| 2,110,573 | 3/1938 | Greene | 75/10.46 |
| 4,144,189 | 3/1979 | Kirkbride | 204/157.43 |
| 4,311,520 | 1/1982 | Kruesi et al. | 423/49 |
| 4,321,089 | 3/1982 | Kruesi et al. | 423/49 |
| 4,324,582 | 4/1982 | Kruesi et al. | 423/38 |
| 4,365,975 | 12/1982 | Williams | 204/157.43 |
| 4,441,290 | 4/1984 | Wilkening | 75/10 R |
| 4,545,879 | 10/1985 | Wan et al. | 204/157.43 |

*Primary Examiner*—Robert L. Stoll

*Attorney, Agent, or Firm*—Hamilton, Brook, Smith & Reynolds

[57] ABSTRACT

The present invention provides a leaching or smelting precursor method of drying and heating particulate ores or concentrates which have been previously intimately admixed with either an already active form of carbon or with some other carbon-containing material which can be readily dried and heated to charring temperatures by microwave energy comprising irradiating the composite with microwave energy.

5 Claims, 1 Drawing Sheet

MICROWAVE IRRADIATION OF COMPOSITES

FIELD OF THE INVENTION

This invention relates to precursor treatment of mineral ores or concentrates ahead of metallurgical extraction processes.

BACKGROUND ART

It has been known for several decades that microwave energy can be used to excite certain molecular species and particularly water molecules and hydroxyl radicals. Furthermore, the microwave excitation can penetrate several centimeters into materials containing water or hydroxyl radicals. The heating effects generated by this molecular excitation are the basis for microwave cooking of food and the drying of damp or water-containing materials.

This invention proceeds from the unexpected effect of microwave energy upon particulate ores or concentrates which have been previously intimately admixed with either an already active form of carbon or with some other carbon-containing material which can readily be dried and heated to charring temperatures by microwave energy.

Not only has microwave energy been found to rapidly dry and heat these admixtures but also reduction reactions can be initiated within the mixtures.

BRIEF DESCRIPTION OF THE INVENTION

Accordingly, in one aspect, this invention provides a leaching or smelting precursor method of drying and heating particulate ores or concentrates which have been previously intimately admixed with either an already active form of carbon or with some other carbon-containing material which can be readily dried and heated to charring temperatures by microwave energy comprising irradiating the composite with microwave energy.

Preferably, irradiation is continued after drying to heat the composite to in excess of 300° C. and initiate reduction reactions within the mixture.

In a second aspect, the invention provides a method of reducing oxidic ores comprising:

(i) mixing said ores with carbonaceous material to form a composite;

(ii) irradiating said composite with microwave energy to dry and heat to cause charring of the carbonaceous material; and (iii) further irradiating the composite to in excess of 100° C. to initiate reduction reactions within the composite.

In a third aspect, the invention provides a method of recovering valuable elements from solid oxidic wastes, such as dusts or fumes, comprising:

(i) mixing said wastes with carbonaceous material to form a composite;

(ii) irradiating said composite with microwave energy to dry and heat to cause charring of the carbonaceous material; and (iii) further irradiating the composite to in excess of 100° C. to initiate reduction reactions within the composite.

The carbon containing materials used in the composites are preferably finely comminuted peat, brown coal or lignite or finely comminuted plant matter such as wood, bark, straw, leaves, sugar cane, reeds or like material. The use of such materials can have significant economic advantages.

Prior to irradiating the composites the mixture of the particulate ores or concentrates with the comminuted carbon and water containing material it is highly advantageous if the mixture is compressed into compacts by, for example, briquetting, extrusion or pelletising. In this specification the compressed compacts are referred to as "composites".

It has been found that "green" or slightly moist composites respond to microwave energy irradiation in the following manner. First drying takes place with heat being generated deep within the composites forcing water out as both steam and mist.

The inside temperature rises relatively rapidly to between 90° and 99° C. and remains below 100° C. until most of the free water is driven out; the heating rate then accelerates rapidly and charring of the carbonaceous material begins with pyrolysis products making their way from the inside to the outside of the composites. As the charring progresses, reduction reactions begin with the intimately mixed finely particulate ores or concentrates.

In the case of oxidic ores, the reactions within the composites are reduction reactions involving both the rapidly forming active carbon and carbon monoxide formed from it. It is possible that nascent hydrogen and hydrocarbons also begin to participate in the reactions and add to the potency of the reduction conditions.

Simply expressed, the reactions are of the type:

$$MO+C \rightarrow M+CO$$

$$MO+CO \rightarrow M+CO_2$$

$$MO+2H \rightarrow M+H_2O$$

$$CO_2+C \rightarrow 2CO$$

where M stands for a metal such as iron, manganese, titanium, chromium, zinc, tin and the like.

It has been found in small bench scale experiments with a batch microwave oven that the reduction reactions can also be induced with carbonate type ores such as malachite ($Cu_2(CO_3)(OH)_2$), and siderite ($FeCO_3$).

In the case of sulphide concentrates it appears that the reducing conditions generated by the pyrolysis reactions and active carbon are supplemented by the microwave energy excitation of the sulphide ions themselves. It appears that not only does the labile sulphur get liberated from sulphides such as pyrite ($FeS_2$) and chalcopyrite ($CuFeS_2$), but the molecular linkages with more tightly bound sulphur are also severed and "roasting" reactions take place extremely rapidly.

In the case of chalcopyrite-containing composites, for example, when air is freely available, the charring is accompanied by the rapid evolution of elemental sulphur, sulphur monoxide as well as sulphur dioxide and the hot composites rapidly convert to a mixture of copper and iron oxides. The copper in this mixture is readily leachable.

If the microwave irradiation of the chalcopyrite-containing composites takes place with strictly limited supply of air and sufficient carbon remains in the lumps, the products of the reduction reactions contain considerable metallic copper and metallic iron and such material is admirably suited to bath smelting-reduction for direct metal production.

It is apparent from bench scale work in a batch type microwave oven that sulphur is also liberated when the composites contain the zinc sulphide, sphalerite, (ZnS), and lead sulphide, galena, (PbS). As the carbonization progresses both zinc and lead can be caused to fume out of the composites and such metal vapors rapidly oxidize exothermically to oxidic fume when air is freely available.

For practical applications in precursor treatment of composites ahead of metallurgical extraction processes it is preferred that a continuous microwave oven is used for irradiation of the composites. A particularly suitable device is the compact continuous microwave oven developed by Industrial Microwave Applications Pty. Limited in New South Wales, Australia. The development improves the commercial practicality of continuous microwave irradiation of composites ahead of either leaching or smelting.

With continuous microwave ovens, the green composites are carried on appropriate refractory belts or other suitable conveying systems into the microwave "cavity" where the magnetrons beam energy either directly or via wave guide systems onto the composites.

For some precursor treatments it is appropriate to separate the drying phase from the rapid heat-up to reaction temperatures. In such cases, two continuous microwave ovens are advantageous, operating in sequence.

The hot and rapidly reacting composites are discharged into an appropriate refractory lined chute to take them directly into either the leaching vat(s) or the smelting furnace(s).

The preferred smelting systems are those coming to be known as "smelt-reduction" or "bath" smelting furnaces.

Reverting to the reactions which the microwave energy initiates within the composites, it appears that unusual types of reduction reactions take place. The temperatures reached seem to be considerably below those which would be needed in conventional pyrometallurgical roasting or reduction furnaces.

It is not suggested that the laws of thermodynamics are being "bent"; rather it is postulated that on a molecular scale the temperatures generated by the microwave excitation of carbon and/or sulphur as the case may be, are much higher then the "bulk" temperature of the composite. Temperatures measured by thermocouple probes or infra-red temperature sensing devices are not as high as the reaction products would indicate.

At this time it is presumed that physical excitation effects superimpose themselves on the chemical activation energies that pertain when hot active carbon, possibly also nascent hydrogen, and sulphide ions participate in reactions.

It is clear from experimental work carried out that the microwaved and fast reacting composites smelt or leach extremely rapidly in unit operations immediately after the precursor treatment.

While there are advantages in the immediate transfer of the hot reacting composites to the leaching vats or the bath smelting furnaces, the energy induced in the composites by the microwaving treatment keeps them reacting for some minuets after they are discharged from the microwave oven proper.

BRIEF DESCRIPTION OF THE ILLUSTRATIONS

FIG. 1 is a photomicrograph of chill cast iron with titanium carbonitride particles dispersed amongst the iron carbide ($Fe_3C$). The specimen has been lightly etched in 2% nital. Magnification × 500.

FIG. 2 is a photomicrograph of sand cast grey cast iron showing titanium carbo-nitride particles dispersed in matrix. The larger black flakes are graphite. The specimen is unetched. Magnification × 500.

DESCRIPTION OF THE PREFERRED EMBODIMENTS

Figure 1:
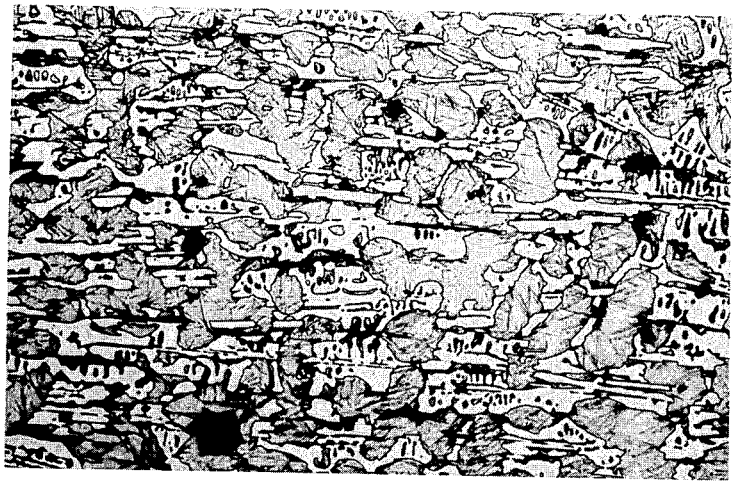

The following examples serve to illustrate, without limiting the scope of this invention. In particular it will be understood that the examples listed are merely indicative of a wide range of applications within the metals extraction industry and particularly to the production of high end value metals and alloys including those produced from the so-called "refactory" ores and concentrates. In the small-scale smelting experiments described, either gas or electric induction furnaces were used to supplement the heat generated in the oxygen smelting operation. It is believed that no such supplementary heat would be necessary in commercial scale smelt-reduction operations.

EXAMPLE 1

Cobar copper concentrates containing approximately 24% copper, 29% iron and 33% sulphur with other minor amounts of lead, zinc and gangue minerals, were intimately mixed with finely comminuted peat from the Bowral area in New South Wales and in the proportions 80% concentrates to 20% peat (dry basis). The plastic mass was formed into pellets about 2 cm diameter. After a few hours of solar drying the still slightly damp pellets were passed on a belt through a bench type 2 kw continuous microwave oven (frequency 2450 MHz).

The pellets were almost completely dry after the first pass through the small oven; they were dry after the second pass (also involving 15 seconds in the microwave cavity.) On the third pass, i.e. 45 seconds only of total irradiation, labile sulphur and possibly a little sulphur monoxide began to be driven out of the composites. At this stage the pellets had reached a temperature too hot to safely put them back onto the plastic conveyor belt. It was apparent that the pellets were beginning to react rapidly and would have been in a suitable condition for discharging into a bath smelting furnace. The pellets remained too hot to touch with the hand for at least three minutes after removal from the third pass through the experimental continuous microwave oven.

EXAMPLE 2

Pilbara Western Australia hematite ore fines (screened - 5 mm) were intimately mixed with finely comminuted Victorian (Morwell) brown coal in the proportion 75% ore to 25% brown coal (dry basis) and the plastic mass was pressed by extrusion into small blocks approximately 2×3×5 cm dimensions. After drying in the laboratory for some days the total moisture level in the composites had decreased to about 10%. These slightly damp composites were passed through the same bench scale continuous microwave oven as was used in Example 1.

After the first pass (15 seconds irradiation) the moisture had been reduced to less than 5%. That residual free water was eliminated in the second 15 second duration pass. By the third pass through the oven the composites had begun to heat rapidly and it was observed that the red-brown hematite in the composites had turned a dark grey color and had become magnetic indicating a reduction to magnetite ($Fe_3O_4$) with 11% less oxygen than hematite ($Fe_2O_3$).

At that stage the composites were too hot to place back on the plastic belt in the microwave oven so the experiment was discontinued. The composites remained too hot to touch with the hand for over five minutes. Such hot partially reduced and active carbon-containing composites would have formed excellent feed to a bath smelting furnace.

EXAMPLE 3

Cobar copper concentrates as had been used in Example 1 were mixed with finely comminuted Bowral area peat in the ratio 85% concentrates to 15% peat (dry basis) and formed into pellets about 2.0 cm diameter. These were dried in a laboratory 650W microwave oven over a period of five minutes. As the microwave irradiation continued it was noted at about six minutes that reaction products began to be emitted and labile sulphur and sulphur dioxide could be detected. By six and a half minutes the reaction in the pellets had become quite vigorous. The reacting pellets were removed from the oven in their refractory container and transferred to a fume cupboard. The "roasting" reaction continued rapidly over the next two minutes and all the residual carbon burned out leaving a reddish brown hot mixture of finely particulate copper and iron oxides. The hot completely reacted pellets were discharged into a flask containing a solution of ammonia and ammonium carbonate and rapid dissolution of the copper occurred. After two minutes stirring the deep blue solution was separated from the iron oxide residue by filtration. Analysis of the iron oxide residue after washing with water indicated that recovery of the copper into the ammoniacal leach liquor was virtually complete. Recovery of copper from this leach liquor could be effected by any one of several well known technologies.

EXAMPLE 4

Cobar concentrates, as had been used in Examples 1 and 3, were thoroughly mixed with finely comminuted Bowral area peat and fine sawdust in the ratio 75% concentrates, 15% peat and 10% sawdust (dry basis). The plastic mass was formed into small briquettes (2 cm diameter 2.5 cm long) in a laboratory briquetting machine. The damp composites were dried out over 4 minutes in a 650 W bench scale microwave oven. After 4.5 minutes irradiation the composites were beginning to react vigorously in a thin refractory container. The hot reacting composites were charged into an experimental gas fired crucible furnace and a jet of air enriched with oxygen to about 50% oxygen was directed into the crucible. Smelting was extremely rapid; a foaming slag formed and jetting continued via a zirconia lance.

After 30 minutes of bath smelting the crucible was removed and its contents of slag and metal were cast into molds. The fluid slag contained less than 0.6% copper and the metal analysis was as follows:

Copper: 93.0%
Iron: 4.6%
Sulphur: 1.1%
Zinc: 0.5%
Lead: 0.4%

It is apparent that the intensive reducing conditions in the microwaved composites had enabled the bath smelting to produce copper metal directly and, furthermore, iron had been reduced as well as copper.

Further jetting with the oxygen-air mixture reduced the iron content as well as the other impurities so that the composition became similar to blister copper made from cobar concentrates in a conventional smelter. A typical final smelter product made by the technology described herein was:

Copper: 98.4%
Iron: 0.2%
Sulphur: 0.3%
Zinc: 0.2%
Lead: 0.2%

Other supplementary experiments indicated that the percentage of iron reduced into the metal phase could be varied by altering the proportions of concentrates and carbonaceous material in the original composites; the more peat, or peat plus sawdust incorporated into the composites the more iron reduced into the metal in the bath smelting. When the proportion of peat was reduced below 20% (dry basis) the copper produced in the bath smelting operation contained less than 0.5% iron and a little white metal ($Cu_2S$) occurred with the copper in the solidified product of bath smelting.

EXAMPLE 5

Pilbara area hematite fines, (screened -2mm) and analyzing 63.5% Fe were intimately mixed with finely comminuted Victorian (Morwell area) brown coal and a little finely comminuted Collie (WA) coal and burnt lime in the proportions:

Iron Ore Fines: 65%
Brown Coal: 24% (dry basis)
Collie Coal: 9% (dry basis)
CaO: 2%

The plastic mass was molded into briquettes in a laboratory briquetting machine (as had been used in Example 4). The composite briquettes were dried in a laboratory microwave (650 W) oven over 4 to 5 minutes.

After about 5 minutes irradiation pyrolysis products were being emitted from the composites and they heated up rapidly over the next 30 seconds until they were glowing red in the refractory container. In this condition successive charges were transferred rapidly to a bath smelting furnace with a fine jet of oxygen directed into the foaming slag in a large crucible in a gas fired furnace.

The metal collected after one hour smelting weighed 4.5 Kg and on analysis was found to contain 3.8% carbon about 0.6% of silicon and about 0.07% sulphur. The slag was not assayed but from its light grey color was obviously low in iron as would be expected over a metal containing 3.8% carbon. Bath temperatures ranged between 1475° and 1520° C.

The experiment demonstrated the speed with which reduction reactions can be initiated in a microwave oven, even in a low powered oven and the speed at which the hot reacting composites can be smelted in a bath covered with foaming slag.

The present invention may also be applied to the recovery of valuable elements from waste material.

Dusts collected from electrostatic precipitators of electric furnace plants of steelworks may contain zinc oxide as well as oxides of valuable alloying elements such as chromium, nickel, manganese and molybdenum. Currently, these dusts, in common with other zinc - containing dusts from oxygen steelmaking, are dumped. Obviously, it would be advantageous to be able to recover these valuable elements. The following example illustrates the application of the present invention in this regard.

Dust containing approximately 40% iron (as oxides, spinels, etc) was analyzed:

Silica: 7.4%
CaO: 3.1%
MgO: 1.7%
Manganese: 8.6%
Chromium: 7.9%
Nickel: 3.0%
Zinc: 1.2%

This dust was blended with finely comminuted Victorian brown coal paste in the proportion 55% electric furnace dust, 43% brown coal (dry basis) and 2% burnt lime. The thick paste was extruded into 2cm diameter "sticks" and solar dried down to approximately 5% free moisture. The composite "sticks" were then microwaved in batches in a 1300 W, 2450 MHz, microwave oven over 2 to 3 minutes until they were pyrolysing vigorously and beginning to show areas of dull red heat (about 550° C.). The batches were transferred rapidly to a small oxygen smelting "crucible" in a large gas fired furnace with additions of small amounts of burnt lime after every third batch of hot microwaved composites. A 5 kg heel of plain carbon cast iron was used in the crucible. Samples of the alloy were cast for analysis. The metal temperature at the time of casting the sample bars was 1500° C.

The alloy analyzed:

Carbon: 4.85%
Silicon: 1.04%
Sulphur: 0.04%
Phosphorus: 0.04%
Manganese; 1.33%
Chromium: 1.11%
Nickel: 0.61%
Molybdenum: 0.45%
Vanadium: 0.025%
Zinc: 0.01%

This alloy cast iron was very hard and tough as would be expected from the alloying elements recovered in it. Zinc had virtually all been eliminated in the fume, which in practice would make a suitable feed material for the sinter plant ahead of an Imperial Smelting Furnace for zinc and lead recovery.

The slag produced weighed only about 10% of the alloy produced and although it contained about 8.5% total iron, total chromium and 0.3% nickel, the total metal losses were relatively small.

The technology certainly shows promise of providing a means of recovering both zinc and valuable alloying elements in currently dumped steelworks dusts.

EXAMPLE 7

To explore the potential of the technology described herein to the recovery of chromium from refractory grade chromite, the following experiment was conducted. Refractory grade chromite from the Phillipines was ground to 100% minus 0.5 mm. It contained:

$Cr_2O_3$: 33%
$Al_2O_3$: 27%
FeO: 12%
$SiO_2$: 4%

This would be regarded as most unsuitable for smelting by conventional blast furnace or electric furnace technologies.

The ground chromite was blended with fine 63.5% Fe Pilbara hematite iron ore (also ground until 100% was minus 0.5 mm) in the ratio one part of refractory grade chromite to one part of iron ore. The mixed chromite-hematite fines were then thoroughly blended with finely comminuted Victorian brown coal paste and char fines from Victorian brown coal in the following ratio:

Refractory Chromite-Hematite: 50%
Brown coal paste: 30% dry basis
Brown coal char fines: 20% and the thick paste was extruded into "sticks" as in Example 6.

The "sticks" were solar dried down to less than 5% free moisture and batches of these composites were heated in the microwave oven as described in Example 6. The hot rapidly pyrolysing sticks were oxygen smelted in a large salamander crucible in an induction furnace. The power fed into the coil of the induction furnace was carefully controlled to bring the temperature of the 5 Kgm heel of plain carbon cast iron to 1550° C. and regular temperature measurements were made during the additions of the hot microwaved composites. The bath temperature varied within the range 1540° to 1580° C. and regular lime flux additions were made.

Smelting of the composites continued until the weight of the alloy in the salamander crucible had increased by approximately 50%. Samples of the alloy were then cast into bars for both microscopic examination and spectrographic analysis.

The alloy was found to contain:

Carbon: 4.55%
Chromium: 5.3%
Silicon: 4.2%
Manganese: 0.35%
Sulphur: 0.01%
Phosphorus: 0.06%

The slag weight was approximately one fifth of the weight of alloy made. It was not analyzed but from its light gray color it was clear that it contained relatively little iron and chromium and so the recovery of chromium into the extremely hard white iron was estimated to be over 85% despite the extreme refractoriness of the chromite ore used.

EXAMPLE 8

Having demonstrated the applicability of the technology described herein to the smelting of refractory grade chromite it was decided to see if titanium in ilmenite ($FeOTiO_2$) could also be reduced and caused to enter the iron rich alloy rather than go almost wholly into slag as is the case when smelting ilmenite-containing magnetites in conventional blast furnaces or electric furnaces.

The experimental procedures for Example 8 were similar to those used in Example 7. ie. Ilmenite was ground to 100% minus 0.5 mm and blended with equally fine hematite ore in a 50:50 ratio. This blend was then thoroughly blended into the brown coal-brown coal char paste in the proportions:

Ilmenite-Hematite blend: 50%
Brown coal char fines: 18%
Burnt lime: 2%

The thick paste was extruded into 2 cm diameter "sticks" which were then solar dried to less than 5% free moisture. Batches of rapidly pyrolysing microwaved composite sticks were then charged at regular intervals into the large salamander crucible in the induction furnace and oxygen smelted. As with Example 7, a heel of 5Kgm of plain carbon iron was used as the bath for the smelting operation and the bath temperatures were maintained between 1540° C. and 1580° C. Regular burnt lime flux additions were made to maintain a fluid, slightly foaming slag.

Additions of the hot microwaved composites were continued until the slag began to show signs of becoming pasty, indicating that the capacity of the metal alloy to take up titanium had reached its limit at the temperatures being used (1540° to 1580° C.) and titanium oxide then began to increase in the slag.

Figure 2:
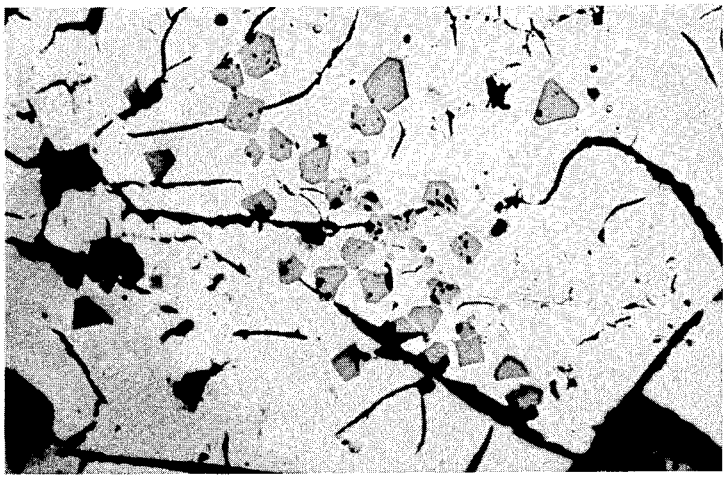

The alloy was cast into sample bars - some in metal molds and some in sand molds. The former were alloy white cast iron as shown in photomicrograph FIG. 1 and the sand cast samples were gray irons (FIG. 2). Both, but particularly the more slowly cooled sand cast samples showed that the alloy contained a fine dispersion of titanium carbide or carbo-nitride and confirmed the ability of this technology to produce very hard and wear resistant irons based on ilmenite additions to the composites before microwaving and oxygen smelting.

I claim:

1. A smelting precursor method of drying and heating particulate ores or concentrate, comprising the steps of:

a. intimately admixing particulate ores or concentrate to form a compact composite with a low-rank oxygen-carbon-containing material selected from the group consisting of finely comminuted past, brown coal and lignite, and finely comminuted plant matter;

b. compressing the composite;

c. irradiating the compressed compact composite with microwave energy to dry and heat the carbon-containing material to cause charring of said carbon-containing material; and d. further irradiating the compressed composite to a temperature in excess of 300° C. to initiate reduction reactions within the composite as a precursor step to smelting.

2. A method of reducing oxidic ores, comprising the steps of:

a. mixing oxidic ores with low-rank, oxygen-containing carbonaceous material to form a compact composite, wherein the carbonaceous material is selected from the group consisting of finely comminuted peat, brown coal and lignite, and finely comminuted plant material;

b. compressing the composite;

c. irradiating the compressed compact composite with microwave energy to dry and heat the composite to cause charring of the carbonaceous material; and d. further irradiating the composite to a temperature in excess of 300° C. to initiate reduction reactions within the composite as a precursor step to smelting.

3. A method of recovering selected elements from solid oxidic wastes, comprising the steps of:

a. mixing solid oxidic wastes with carbonaceous low-rank, oxygen-containing material to form a compact composite wherein the carbonaceous material is selected from the group consisting of finely comminuted peat, brown coal and lignite, and finely comminuted plant material;

b. compressing the composite;

c. irradiating the compressed compact composite with microwave energy to dry and heat the composite to cause charring of said carbonaceous material; and d. further irradiating said composite to a temperature in excess of 300° C. to initiate reduction reactions within the composite as a precursor step to smelting.

4. A method according to claim 1, 2 or 3 wherein the composite is compressed into briquettes.

5. A method according to claim 4 wherein the compacts are selected from the groups consisting of briquettes, extrusions and pellets.

* * * * *